US007621824B2

(12) United States Patent
Sano

(10) Patent No.: US 7,621,824 B2
(45) Date of Patent: Nov. 24, 2009

(54) GOLF CLUB HEAD

(75) Inventor: Yoshinori Sano, Kobe (JP)

(73) Assignee: SRI Sports Limited, Kobe (JP)

( * ) Notice: Subject to any disclaimer, the term of this patent is extended or adjusted under 35 U.S.C. 154(b) by 160 days.

(21) Appl. No.: 11/320,761

(22) Filed: Dec. 30, 2005

(65) Prior Publication Data

US 2006/0172819 A1 Aug. 3, 2006

(30) Foreign Application Priority Data

Feb. 1, 2005 (JP) ..... 2005-25456

(51) Int. Cl.
*A63B 43/04* (2006.01)

(52) U.S. Cl. ..... 473/345; 473/349; 473/314; 473/342

(58) Field of Classification Search ..... 473/324, 473/329, 345; *A63B 53/04*
See application file for complete search history.

(56) References Cited

U.S. PATENT DOCUMENTS 2,575,962 A * 11/1951 Jaffee et. al. ..... 420/418
5,219,521 A * 6/1993 Adams et al. ..... 420/418
6,623,377 B2 * 9/2003 Evans et al. ..... 473/342
6,669,577 B1 * 12/2003 Hocknell et al. ..... 473/329
7,077,761 B2 * 7/2006 Nishio ..... 473/314
2003/0092504 A1 * 5/2003 Nishio ..... 473/342
2005/0059508 A1 * 3/2005 Burnett et al. ..... 473/349
2005/0101404 A1 * 5/2005 Long et al. ..... 473/331
2005/0159239 A1 * 7/2005 Imamoto et al. ..... 473/338
2005/0266933 A1 * 12/2005 Galloway ..... 473/342

FOREIGN PATENT DOCUMENTS

EP 0 923 963 A1 * 4/1998
JP 8-280853 A 10/1996
JP 09-253242 A * 9/1997
JP 2002-360746 * 12/2002

* cited by examiner

*Primary Examiner*—Gene Kim
*Assistant Examiner*—Michael D Dennis
(74) *Attorney, Agent, or Firm*—Birch, Stewart, Kolasch & Birch, LLP

(57) ABSTRACT

A golf club head comprises a club face provided with a high-strength part whose tensile strength is in the range of from 950 to 2200 MPa, wherein the high-strength part has Young's modulus in the range of from 120 to 160 GPa.

9 Claims, 5 Drawing Sheets

GOLF CLUB HEAD

BACKGROUND OF THE INVENTION

1. Field of the Invention

The present invention relates to a golf club head and method manufacturing the same, more particularly to a club face with a high-strength part which can improve its durability, directionality for hit ball and rebound performance.

2. Description of the Prior Art

In general, in order to increase a distance of a hit ball, a golf club head with a great volume is proposed. Such a golf club head, for example, comprises a titanium alloy such as Ti-15-Mo-5Zr-3Al or Ti-6Al-4V.

By the way, in order to use a golf club in an official competition, a club head must have a coefficient of restitution less than 0.830. Most of club heads already sold have a coefficient of restitution exceeding 0.830. Therefore, club head makers have to make a club head with coefficient of restitution smaller than before.

In general, the coefficient of restitution of a club head becomes large by making rigidity of a face portion thereof small. For example, if a thickness of a face portion of a club head is made small, the coefficient of restitution of the club head will become large. Therefore, in order to reduce a coefficient of restitution of a club head, it is necessary to enlarge a thickness of a face portion.

However, if the thickness of the face portion is enlarged, a weight of the face portion will increase relatively and a depth of center of gravity of a club head will become small.

For example, in a hollow driver club head made of titanium alloy with a head volume of 400 $cm^3$ and an area of club face of 40 $cm^2$, if a thickness of the face portion of the club head increase by 0.5 mm, a weight of the face portion will increase 5 g or more in general.

Such a club head with a small depth of the center of gravity does not have the good directionality of a hit ball since the rotation of the club head becomes large at the time of a misshot.

SUMMARY OF THE INVENTION

It is therefore, an object of the present invention to provide a golf club head with a high durability, a great depth of center of gravity and a proper coefficient of restitution.

According to one aspect of the present invention, a golf club head comprises a club face provided with a high-strength part whose tensile strength is in the range of from 950 to 2200 MPa, wherein the high-strength part has Young's modulus in the range of from 120 to 160 GPa.

DESCRIPTION OF THE PREFERRED EMBODIMENTS

Figure 1:
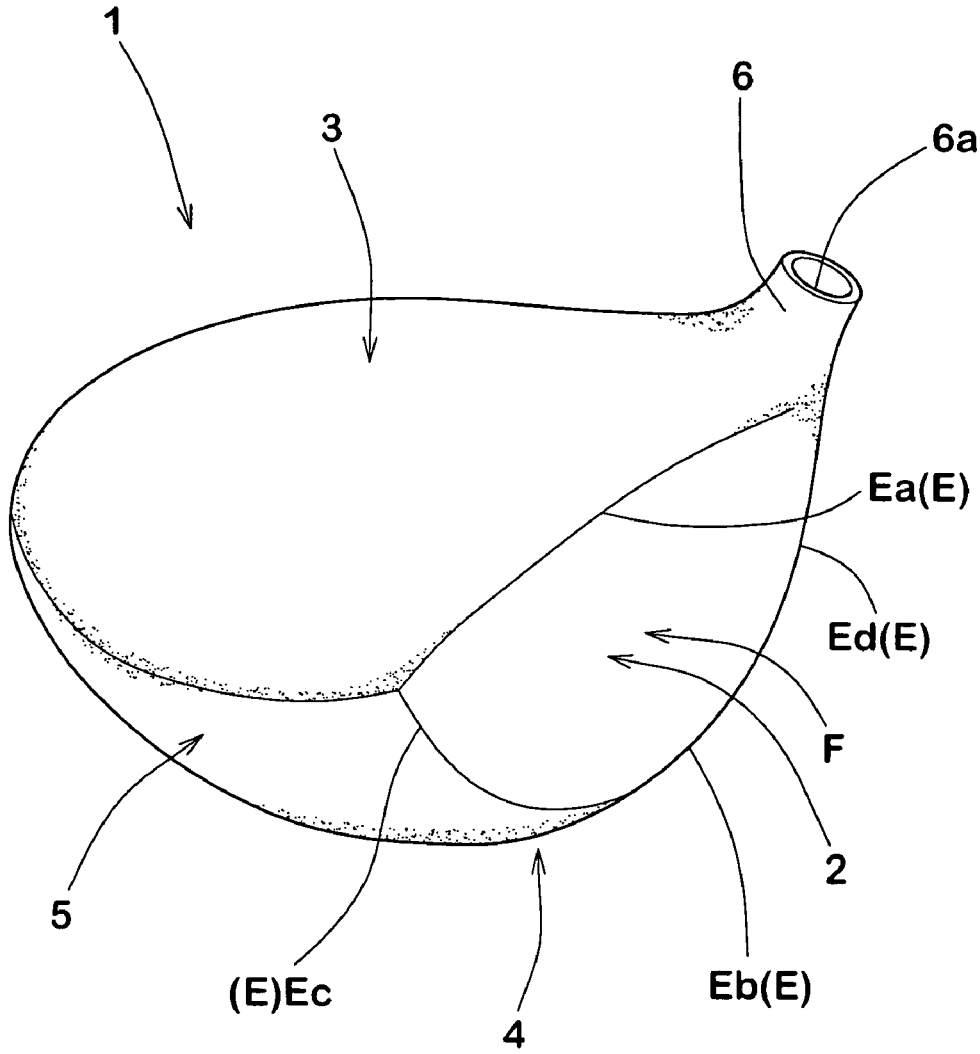
FIG. 1 is a perspective view of a wood-type golf club head according to the present invention under a standard state.

Embodiment of the present invention will now be described in detail in conjunction with the accompanying drawings.

A golf club head 1 according to the present invention is preferably a metal wood-type hollow structure. The golf club head 1, as illustrated in FIGS. 1 to 3, comprises: a face portion 2 whose front face defines the club face F for hitting a ball; a crown portion 3 intersecting the club face F at the upper edge Ea thereof; a sole portion 4 intersecting the club face F at the lower edge Eb thereof; a side portion 5 between the crown portion 3 and the sole portion 4 which extends from a toe-side edge Ec to a heel-side edge Ed of the club face F through the back face of the club head 1; and a hosel 6 having an insertion hole 6*a* to be attached to the club shaft (not shown).

Figure 2:
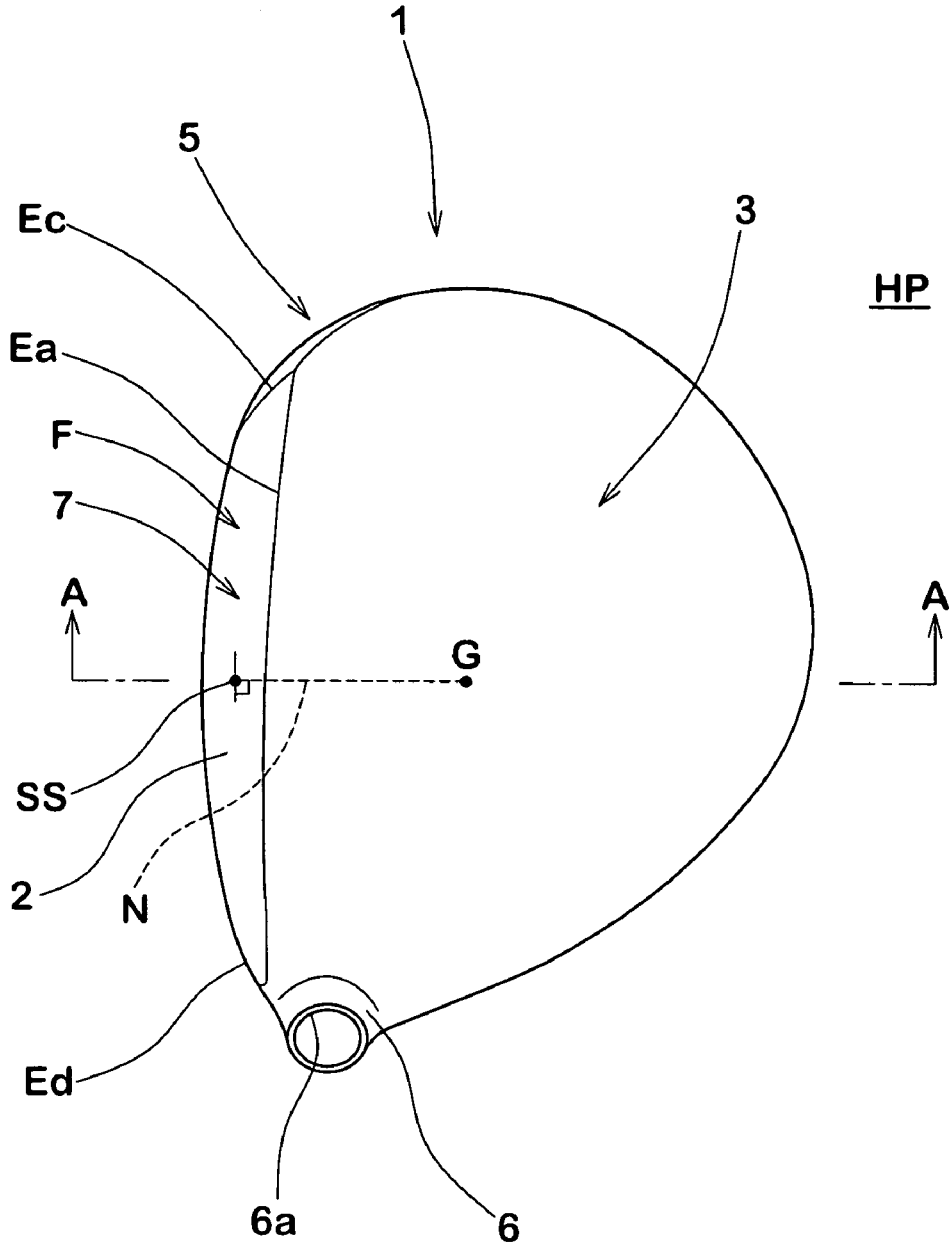
FIG. 2 is a plan view of FIG. 1.
Figure 3:
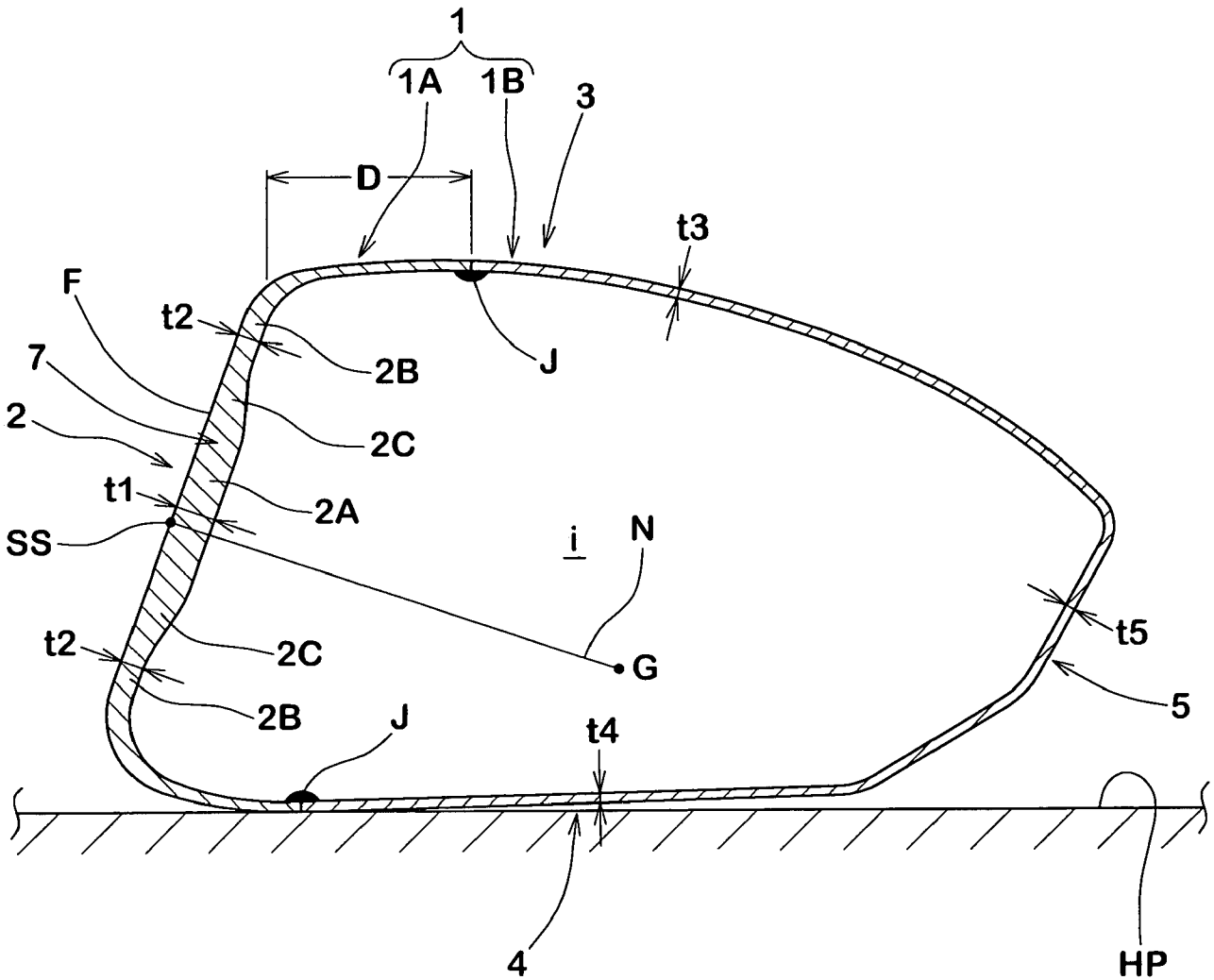
FIG. 3 is a cross sectional view taken along on line A-A in F*ig*. 2.

The golf club head 1 in FIGS. 1 to 3 is shown under a standard state that the club head 1 is set on a horizontal plane HP while keeping its lie angle and loft angle (Real loft angle).

A volume of the club head 1 is not particularly limited, but if the volume of the club head 1 becomes too small, it is hard to enlarge the moment of inertia of the club head 1. On the contrary, if the volume becomes too large, there is a tendency that the weight of the club head 1 is increased and is hard to be swung. Therefore, it is desirable that the volume of the head 1 is preferably set not less than 300 $cm^3$, more preferably not less than 350 $cm^3$, further preferably not less than 400 $cm^3$, especially preferably not less than 410 $cm^3$. Further, it is desirable that an upper limit thereof is preferably set not more than 500 $cm^3$, more preferably not more than 450 $cm^3$ and more preferably not more than 420 $cm^3$.

A weight of the club head 1 is not particularly limited, but it is desirable that the weight is preferably set not less than 170 g, more preferably not less than 175 g, and further preferably not less than 180 g. Further, it is desirable that an upper limit thereof is not more than 200 g, more preferably not more than 195 g, and further preferably not more than 190 g.

The club head 1 in accordance with the present embodiment is made up at least two parts including a face component 1A and a head main body 1B. The face component 1A is a single metal part. The head main body 1B is also a single metal part in this embodiment, but it may be an assembly of two or more parts. Therefore, in this embodiment as shown in FIG. 4, the club head 1 is a two-piece structure, and the face component 1A is welded to the head body 1B.

Figure 4:
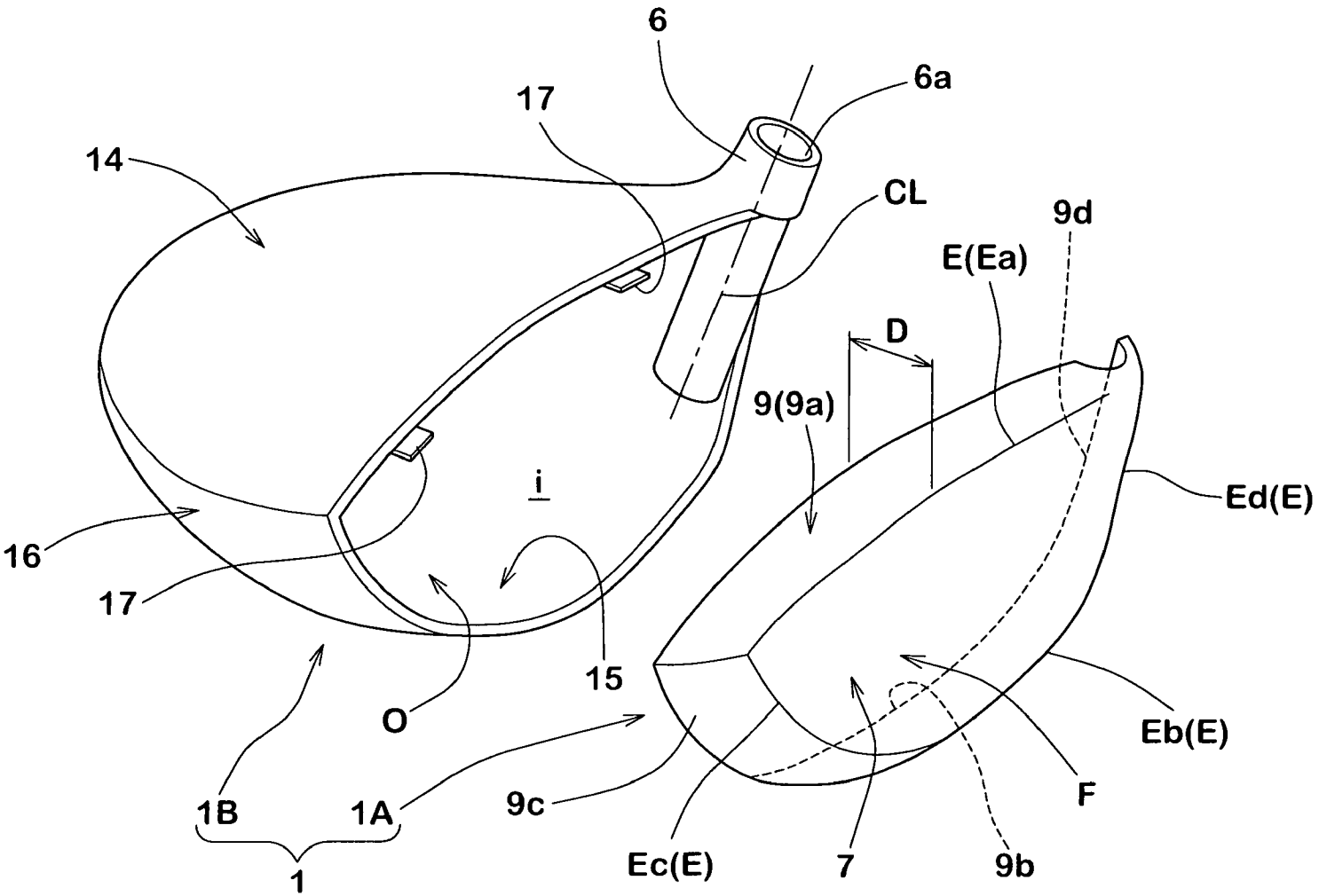
FIG. 4 is an exploded view of the golf club head showing an example of two piece structure.

As shown in FIG. 4, the head main body 1B comprises: a major part 14 of the crown portion 3; a major part 15 of the sole portion 4; a major part 16 of the side portion 5 between the major parts 14 and 15; the hosel 6; and an opening (O) which is closed with the face component 1A is formed in the front of the head main body 1B.

The head main body 1B is provided along the edge of the opening (O) with a plurality of catches 17 for locating the face component 1A accurately during welding while forming a small gap therebetween to be bridged with a weld metal.

As for the material of the head main body 1B, various metal materials, e.g. titanium alloys, pure titanium, aluminum alloys, stainless steel and the like may be used.

Further, the head main body 1B can be manufactured, for example, by preparing a plurality of parts, and approximately attaching the parts each other. For example, in order to set a center of gravity of the club head 1 to suitable position, a weight member with a certain specific gravity such as tungsten alloy, aluminum, aluminum alloy or fiber reinforced resin may be attached to the head main body 1B.

In this embodiment, as for the material of the head main body 1B, an alpha-beta titanium alloy Ti-6Al-4V is used, and the head main body 1B is integrally molded, using a lost-wax precision casting method.

The face component 1A is a major part (in this embodiment, the entire) of the club face F. The face component 1A is further provided with a turnback 9 at the edge E (generic expression of the edges Ea, Eb, Ec and Ed) of the club face F.

The turnback 9 extends backwards to form part of the crown portion 3, sole portion 4 and side portion 5. Therefore, the turnback 9 includes: a crown-side turnback 9*a* forming a front end zone of the crown portion 3; a sole-side turnback 9*b* forming a front end zone of the sole portion 4; a toe-side turnback 9*c* forming a front end zone of the toe-side part of the side portion 5; and a heel-side turnback 9*d* forming a front end zone of the heel-side part of the side portion 5. These turnback portions 9*a* to 9*d* are formed by methods such as bending, a casting process, or a forging method except welding. Also, a dent portion corresponding to the hosel 6 is provided in the heel side of the face component 1A.

A welding portion j between the turnback 9 of the face component 1A and the edge of the opening (O) of the head main body 1B is in a position apart from the edge E of the club face F as shown in FIG. 3. If the welding portion j is in the edge E of the club face, a depth center of the gravity becomes small since the welding portion j is left at the-edge E in a hollow portion (j) of the club head 1.

In this point of view, a length L of the turnback 9 in a front-back direction is preferably set not less than 7 mm, more preferably not less than 10 mm and further preferably not less than 15 mm. On the other hand, if the length L of the turnback 9 becomes too long, it is hard to form such a great face component 1A. Therefore, the length L is preferably set not more than 30 mm, more preferably not more than 28 mm and further preferably not more than 25 mm.

The face component 1A comprises a high-strength part 7 at least partially in the face portion 2 whose Young's modulus is in the range of from 120 to 160 GPa and whose tensile strength is in the range of from 950 to 2200 MPa. In this embodiment, the whole of the face component 1A is formed as the high-strength part 7. Therefore, the front zones of the crown portion 3, sole portion 5 and the side portion 6 also have the high-strength parts 7.

Figure 5:
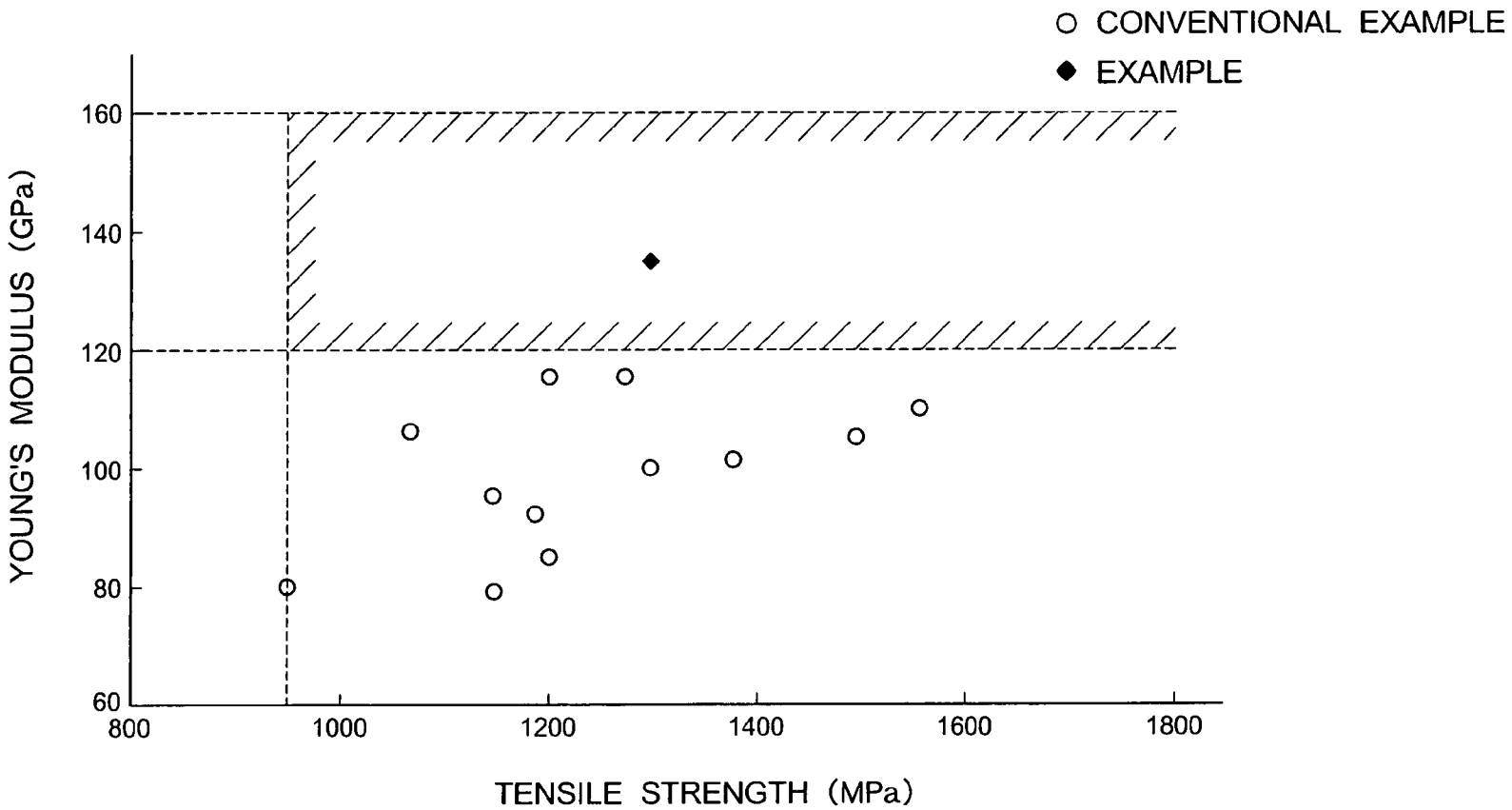
FIG. 5 is a graph showing a relation between Young's modulus and tensile strength of metallic material.

FIG. 5 shows a relation between Young's modulus and tensile strength of metallic alloys. Conventionally, each alloy (conventional examples) used for a golf club head has Young's modulus smaller than 120 GPa. Especially the alloy with large tensile strength has a tendency that Young's modulus thereof becomes small.

On the contrary, the high strength part 7 in accordance with the present embodiment is formed by an alloy with a great Young's modulus. Therefore, such a club head makes it possible to reduce the coefficient of restitution thereof even if the thickness of the face portion 2 is made small. With this, the club head in accordance with the present invention makes it possible to control the rebound performance thereof without reducing the depth of the center of gravity. Also, since the alloy has a high tensile strength, it is possible to maintain the durability of the club head enough even if the thickness of the face portion 2 is made small.

Here, if the Young's modulus of the high-strength part 7 is less than 120 GPa, the depth of the center of gravity becomes small since it is necessary to enlarge a thickness of the face portion in order to control the coefficient of restitution into suitable value defined by USGA. In this point of view, Young's modulus of the high-strength part 7 is preferably set not less than 125 GPa, and more preferably not less than 130 GPa. On the other hand, if the Young's modulus of the high-strength part 7 is more than 160 GPa, the coefficient of restitution becomes too small. So, Young's modulus of the high-strength part 7 is preferably set not more than 155 GPa, more preferably not more than 150 GPa and further preferably not more than 145 GPa.

Further, if the tensile strength of the high-strength part 7 is less than 950 MPa, a great thickness of the face portion 2 is required in order to maintain the durability and strength thereof. Such a club has a problem such that the coefficient of restitution and the depth of center of gravity become too small. In this point of view, the tensile strength of the high-strength part 7 is preferably set not less than 1000 MPa, more preferably not less than 1100 MPa and further preferably not less than 1200 MPa. On the other hand, if the tensile strength of the high-strength part 7 is more than 2200 MPa, the durability of the club head is reduced since toughness thereof becomes decrease. In this point of view, the tensile strength of the high-strength part 7 is preferably set not more than 1800 MPa, and more preferably not less than 1600 MPa.

As for the high-strength part 7, for example, it is suitable that a titanium alloy consist of, in weight %, Al:3.5-6.5%, Fe:0.1-2.0%, and the balance of Ti and at least one inevitable impurity. such a titanium alloy has a specific gravity not more than 4.38, so that the depth of the center of gravity of the club head 1 can be enlarged.

Here, if the content of Al of the titanium alloy is less than 3.5 weight %, there is a tendency that an omega phase which makes the tensile strength of the titanium alloy reduce is generated in the crystal organization thereof. Also, if the content of Al of the titanium alloy is more than 6.5 weight %, it is hard to make the alloy into a certain shape by using plastic deformation thereof. In this point of view, the content of Al is preferably set not less than 4.0 weight %, more preferably not less than 4.5 weight %, but preferably not more than 6.0 weight %, and more preferably not more than 5.5 weight %.

The addictive Fe in the titanium alloy prevents forming of an intermetallic compound, and stabilizes a beta phase of the titanium alloy. Also, ease of workability of the titanium alloy can be improved by adding Fe therein. If the content of Fe of the titanium alloy is less than 0.1 weight %, it is hard to get those effects from the titanium alloy. The content of Fe in the titanium alloy is preferably set not less than 0.5 weight %, more preferably not less than 0.7 weight %, but preferably not more than 1.5 weight %, and more preferably not more than 1.3 weight %.

As for the inevitable impurity of the titanium alloy, for example, at least one of O, N, C and/or H is included. The inevitable impurity is very less.

In order to get a great distance of a hit ball, the coefficient of restitution of the club head 1 is preferably set not less than 0.800, more preferably not less than 0.810, further preferably not less than 0.820 and still further preferably not less than 0.825. On the contrary, in order to comply with the Rules of Golf for Clubs as defined by the USGA, the coefficient of restitution of the club head 1 is preferably less than 0.830.

Here, the coefficient of restitution of the club head 1 is obtained by calculating on the basis of Procedure for Measuring the velocity Ratio of a Club Head for Conformance to Rule 4-1e, Revision 2 (Feb. 8, 1999) in USGA.

As shown in FIG. 3, the face portion 2 also comprises a center portion 2A which has a thickness t1 (in this embodiment, that is the maximum thickness) and an area including a sweet spot SS, and periphery portion 2B provided around the center portion 2A which has a thickness t2 (in this embodiment, that is the minimum thickness) smaller than the thickness t1 of the center portion 2A. Such a face portion 2 can have high durability by central part 2A with the thickness t1 larger than the thickness t2. Also, by bending the periphery portion 2B at the time of hitting of the ball, the coefficient of restitution of the club head 1 is improved to the maximum within the value defined by the USGA. Besides, the depth of the center of gravity of the club head 1 will become small since the weight of the face portion 2 is reduced.

Here, in order to maintain the durability and the suitable coefficient of restitution of the club head 1, the thickness t1 of the center portion 2A is preferably set not less than 2.90 mm, more preferably not less than 2.95 mm, and further preferably not less than 3.00 mm, but it is preferably set not more than 3.20 mm, and more preferably not more than 3.10 mm.

Further, the thickness t2 of the periphery portion 2B is preferably set not less than 2.35 mm, more preferably not less than 2.40 mm and further preferably not less than 2.50 mm, but it is preferably set not more than 2.70 mm, and more preferably not more than 2.60 mm.

In this embodiment, the face portion 2 also comprises a transit portion 2C connecting between the center portion 2A and periphery portion 2B. The transit portion 2C has a thickness gradually changing from the thickness t1 to the thickness t2 so as to improve the durability of the face portion 2.

In order to improve a directionality of hit ball and the distance, the depth of center of gravity of the club head 1 is preferably set not less than 35.5 mm, more preferably not less than 36.0 mm, and further preferably not less than 37.5 mm, but it is preferably set not more than 43.0 mm, more preferably not more than 41.5 mm, and further preferably not more than 40.0 mm.

Here, the depth of center of gravity of the club head 1 is a length of a normal line N which is drawn perpendicular to the club face F from the center G of gravity of the club head 1. Also, a sweet spot SS is defined as a point on the club face F which is the intersecting point of the normal line N with the club face F.

The club head 1 has a moment M of inertia around a vertical axis passing through a center G of gravity of the club head 1 under the standard condition being not less than 4100 $g \cdot cm^2$, more preferably not less than 4200 $g \cdot cm^2$, and further preferably not less than 4400 $g \cdot cm^2$, but it is preferably set not more than 5700 $g \cdot cm^2$, and more preferably not more than 5500 $g \cdot cm^2$. Since the club head 1 in accordance with the present embodiment has the great moment of inertia, it is possible to get an excellent directionality of the hit ball. The moment of inertia mentioned above corresponds to a value of a club head simple substance.

For example, the face component 1A is manufactured by the process which comprises the steps of heating the titanium alloy in the range of from 930 to 950 degrees Celsius for 3 to 30 minutes, and forging the titanium alloy into the face component 1A after the heating.

By using such a manufacturing method, the titanium alloy which has a fine crystal organization without segregation can be obtained so that the durability of the face portion 2 is improved. Also, especially in the hot forging, the mechanical properties, such as tensile strength, hardness, toughness and fatigue-resistant characteristic of the titanium alloy are improved. Further, since the forging can form complicated shape, the face component 1A having the turnback 9 and the face portion 2 with a varying thickness can be formed from the billet easily.

In this embodiment, the forging is performed by heating a billet made of the titanium alloy up to the above-mentioned temperature range and beating or pressing the billet into the specific target shape. At the time of forging, the temperature of the billet is kept the temperature range above-mentioned. In order to improve the strength of the titanium alloy and workability thereof, in advance of the forging, the billet is heated with an electric furnace. When the temperature of the billet is less than 930 degrees Celsius or the heating time is less than 3 minutes, the workability will be deteriorated because the alloy of the billet is difficult to make a plastic flow. On the contrary, when the temperature is more than 950 degrees Celsius or the heating time is more than 30 minutes, the crystal organization of the titanium alloy becomes brittle, and the durability of the face portion 2 is reduced.

As for the forging, various types of forging such as die forging (inclusive of flat die, open die, closed die and semi-closed die) are included. In case of die forging, two-stage forging, namely, pre-forming and finish forging using a rougher and a finisher, respectively, or three-stage forging including additional intermediate forming between the pre-forming and finish forging is desirable. In this embodiment, in order to avoid scale, closed die forging is desirable.

Comparison Tests

Wood-type golf clubs having the specifications shown in Table 1 and the basic structure as illustrated in FIGS. 1 and 2 were made and tested some performances thereof. Each club head has a same condition as follows.

Head volume: 420 $cm^3$

Loft angle: 10 degrees

Head main body: A single casting part made of Ti-6Al-4V

An area of center portion of the club face: 10 $cm^2$

An area of periphery portion of the club face: 33 $cm^2$

Each face component of examples was used a forged part made of titanium alloy of Ti-5Al-1Fe containing of, in weight %, Al:5%, Fe:1% and the balance of Ti and an inevitable impurity.

The heat treatment condition is as follows.

Heating temperature: 940 degrees C.

Heating time: 10 minutes

Each face component of references 1 and 2 is used a forged part made of titanium alloy of Ti-6Al-4v containing of, in weight %, Al:6%, v:4% and the balance of Ti and an inevitable impurity. The heat treatment condition is as follows.

Heating temperature: 990 degrees C.

Heating time: 10 minutes

These face components were welded with head main bodies by TIG welding. The test methods are as follows.

Rebound Performance Test

According to the "Procedure for Measuring the velocity Ratio of a club Head for conformance to Rule 4-1e, Appendix 2, Revision 2 (Feb. 8, 1999), United states Golf Association", the coefficient of restitution (e) of each club head was obtained.

Directionality of Hit Ball Test

The test was executed by hitting golf balls ten times per a test club by ten right-handed golfers whose handicaps ranged from 10 to 20, and measured the difference between a ball stop position and the straight line extending from the position of the golfer to a target point, the directionality of hit ball was evaluated. Here, the measured difference is set to a plus value, even if the stop position of the ball is shifted to the right or the left with respect to the straight line. An average of the differences of each test club was calculated, and evaluated based on the following standard. Further, the results indicate averages of ten golfers. The larger the numerical value is, the better the directionality is.

5: The average of the differences is not more than 7.5 yards.

4: The average of the differences is more than 7.5 and not more than 10.0 yards.

3: The average of the differences is more than 10.0 and not more than 12.5 yards.

2: The average of the differences is more than 12.5 and not more than 15.0 yards.

1: The average of the differences is more than 15.0 and not more than 17.5 yards.

Durability Test

The wood-type club was attached to a swing robot and hit golf balls repeatedly at a head speed of 55 m/s. Then, the number of hit ball was checked until the club head was broken. The result was expressed as the index which sets the number of hit times of Example 1 to 100. The larger the numerical value is, the better the durability is.

Fatigue-Resistant Test of Face Portion

A test piece was made from the face portions of each test club head with a length of more than 30 mm, a width of 20 mm and a thickness of 2.5 mm. The test piece was supported by two jigs with a span of 30 mm, and was applied a vertical force of 1200 MPa with 2 Hz periodically at the center of the span. Then, the number of load times was checked until the test piece was broken. The result was expressed as the index which sets the number of load times of Example 1 to 100. The larger the numerical value, the better the fatigue resistant.

Impact Test of Face Portion

A test piece was made from the face portions of each test club head with a width of 10 mm and a thickness of 2 mm, and measured an impact strength of each test piece by the Charpy test with test energy of 30 j. The result was expressed as the index which sets the impact strength of Example 1 to 100. The larger the numerical value, the better the impact strength.

Test results and the specification of the club heads are shown in Table 1.

On the contrary, each example has a coefficient of restitution less than 0.830, and a great depth of center of gravity and the moment of inertia so that the directionality is good.

The invention claimed is:

1. A hollow wood-type golf club head comprising:

a face portion whose front face defines a club face for hitting a ball, a crown portion intersecting the club face at the upper edge thereof, a sole portion intersecting the club face at the lower edge thereof, and a side portion that is between the crown portion and the sole portion which extends from a toe-side edge to a heel-side edge of the club face through a back face of the club head, wherein a head volume is not less than 400 $cm^3$, a head weight is in the range of from 170 to 200 g, a coefficient of restitution of the club head is not less than 0.800, and less than 0.830, a thickness of the club face at the sweet spot is in the range of from 2.9 to 3.2 mm, a depth of center of gravity of the club head is in the range of from 35.5 to 43.0 mm and a moment of inertia around a vertical axis passing through a center of gravity of the club head under a standard condition that the club head is set on a horizontal plane while keeping its lie angle and loft angle is not less than 4100 $g \cdot cm^2$ and not more than 5700 $g \cdot cm^2$, the head comprises a face component including a major part of the club face and a head main body being welded to the face component to form the club head and having a hosel with an insertion hole to be attached to a club shaft,

TABLE 1

| | Ex. 1 | Ex. 2 | Ex. 3 | Ref. 1 | Ref. 2 | Ref. 3 | Ref. 4 |
|---|---|---|---|---|---|---|---|
| <Face component> | | | | | | | |
| Material | Ti—5Al—1Fe | | | Ti—6Al-4v | | DAT 55G | |
| Specific Gravity | 4.38 | | | 4.42 | | 4.72 | |
| Tensile Strength (MPa) | 1300 | | | 1200 | | 1200 | |
| Young's Modulus (GPa) | 135 | | | 115 | | 85 | |
| Thickness t1 of Center Portion (mm) | 2.92 | 3.05 | 3.18 | 3.20 | 3.35 | 2.75 | 3.50 |
| Thickness t2 of Periphery Portion (mm) | 2.55 | 2.65 | 2.70 | 2.70 | 2.85 | 2.30 | 3.00 |
| Weight of Face Component (g) | 58.5 | 60.9 | 63.4 | 63.8 | 66.7 | 55.0 | 70.3 |
| Moment of Inertia around vertical axis passing through a center of gravity of club head | 4430 | 4370 | 4260 | 4240 | 4130 | 4510 | 4020 |
| <Test Results> | | | | | | | |
| Rebound Performance | 0.828 | 0.822 | 0.810 | 0.837 | 0.827 | 0.860 | 0.828 |
| Directionality of Hit Ball | 4.5 | 4.4 | 3.8 | 3.8 | 3.0 | 4.5 | 2.5 |
| Durability (Index) | 100 | 115 | 130 | 90 | 100 | 110 | 130 |
| Fatigue-Resistant (Index) | 100 | 100 | 100 | 50 | 50 | 50 | 50 |
| Impact Strength (Index) | 100 | 100 | 100 | 30 | 30 | 100 | 100 |

Since the references 1 and 3 each have a small thickness of the face portion, they have the coefficient of restitution greater than 0.830, and the low durability.

Since each reference 2 and 4 each have a great thickness of the face portion and a great weight of the club head, each head has a large depth of center of gravity and a small moment of inertia. So, the directionality is not good.

the face component has the face portion and a turnback which extends backward from the edge of the club face to form a part of the crown portion, sole portion and each side portion, the face portion comprises a center portion which has a thickness t1 and an area including the sweet spot, a periphery portion being provided around the center portion and having a thickness t2 smaller than the thickness t1 of the center portion and a transit portion connecting between the center portion and the periphery portion with a thickness gradually changing from the thickness t1 to the thickness t2, the thickness t1 of the center portion is not less than 2.90 mm and the entire periphery has a thickness t2 of not more than 2.60 mm, the turnback is formed by methods of bending, a casting process, or a forging except welding, the face component is provided with a dent portion at a position corresponding to the hosel of the head main body, the head main body is made of a metal material, the head main body comprises the hosel, a major part of the crown portion, a major part of the sole portion, a major part of the side portion and a front opening which is closed with the face component, the face component consists of a high-strength part made of a titanium alloy whose tensile strength is in the range of 950 to 2200 MPa, and the high-strength part has a Young's modulus in the range of from 120 to 160 GPa, wherein the titanium alloy consists of, in weight %, Al: 3.5-5.0%, Fe: 0.1-2.0%, and the balance of Ti and at least one inevitable impurity.

2. The golf club head according to claim 1, wherein the titanium alloy contains Al of not less than 4.0%.

3. The golf club head according to claim 1, wherein the titanium alloy contains Fe of not less than 0.5%.

4. The golf club head according to claim 1, wherein the high-strength part comprises a forged titanium alloy.

5. The golf club head according to claim 1, wherein the Young's modulus of the high-strength part is not less than 130 GPa.

6. The golf club head according to claim 1, wherein the Young's modulus of the high-strength part is not less than 135 GPa.

7. The golf club head according to claim 1, wherein the tensile strength of the high-strength part is not less than 1300 MPa.

8. The golf club head according to claim 1, wherein a welded portion between the face component and the head main body is located backward apart from the edge of the club face.

9. The golf club head according to claim 1, wherein a length of the turnback portion in a front-back direction is in a range of 7 to 30 mm.

* * * * *

UNITED STATES PATENT AND TRADEMARK OFFICE

CERTIFICATE OF CORRECTION

PATENT NO. : 7,621,824 B2
APPLICATION NO. : 11/320761
DATED : November 24, 2009
INVENTOR(S) : Yoshinori Sano It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 202 days.

Signed and Sealed this

Twenty-sixth Day of October, 2010

David J. Kappos

David J. Kappos
*Director of the United States Patent and Trademark Office*